US005615454A

United States Patent [19]

Contarino

[11] Patent Number: 5,615,454

[45] Date of Patent: Apr. 1, 1997

[54] CARD RETENTION AND SECURITY DEVICE

[76] Inventor: Alfred F. Contarino, 35 Bonny La., North Andover, Mass. 01845

[21] Appl. No.: 539,607

[22] Filed: Oct. 5, 1995

[51] Int. Cl.[6] ..... A44B 21/00; F16G 15/00

[52] U.S. Cl. ..... 24/3.13; 24/3.6; 24/116 A; 24/299

[58] Field of Search ..... 24/3.13, 3.12, 24/3.6, 3.5, 3.1, 116 A, 299, 300

[56] References Cited

U.S. PATENT DOCUMENTS

| | | | |
|---|---|---|---|
| 1,513,383 | 10/1924 | Fleischer | 24/3.13 |
| 1,867,330 | 7/1932 | Schwartzman | 24/715.4 |
| 2,291,089 | 7/1942 | Okun | 24/3.13 |
| 2,457,195 | 12/1948 | Bagnall, Jr. | 24/3.13 |
| 2,681,545 | 6/1954 | Hall | 24/116 A |
| 2,764,797 | 10/1956 | Carson | 24/299 |
| 3,555,623 | 1/1971 | Cocchiaraley | 24/304 |
| 3,727,272 | 4/1973 | Rhodes | 24/300 |
| 3,974,547 | 8/1976 | Little | 24/116 A |
| 5,465,596 | 11/1995 | Park | 24/3.6 |

FOREIGN PATENT DOCUMENTS

| | | | |
|---|---|---|---|
| 0569910 | 4/1924 | France | 24/299 |

*Primary Examiner*—Victor N. Sakran
*Attorney, Agent, or Firm*—Limbach & Limbach L.L.P.

[57] ABSTRACT

A security chain particularly adapted for retaining a magnetically encoded card such as a casino complimentary card including a split ring, detachably coupled to one end of a ball chain with the other end of the ball chain detachable coupled to an alligator clip which can be clipped to the users clothing. The magnetically encoded card can be easily inserted over a right angle tab on the split ring and threaded onto the ring.

7 Claims, 1 Drawing Sheet

CARD RETENTION AND SECURITY DEVICE

FIELD OF THE INVENTION

The invention pertains to an apparatus for preventing individuals from losing items. Particularly, the invention pertains to a security chain for preventing persons from losing magnetically encoded identification cards or the like.

BACKGROUND OF THE INVENTION

Everyone is familiar with magnetically encoded identification cards such as credit cards, pass-key cards for unlocking doors and monthly commuter passes for use with public transportation systems such as subways and commuter rail systems, and ATM (automatic teller machine) cards for use in automated banking.

Such cards include a magnetic strip which is encoded with, for instance, an identification number. When it is desired to use such a card, the card is either swiped through or inserted into a magnetic code reader which can read the encoded information on the card.

How that information is used depends on the particular application. For instance, when the card is a credit card, the card reader at a retailer typically is coupled to a modem so that it can send the identification information which is read from the card over the telephone lines to a central location which will determine if the number is the number of a valid credit card and whether the proposed purchase is within the authorized credit limit for the holder of that card. The remote system will then return information to the retailer indicating whether or not the proposed credit is granted.

On the other hand, if the card is a subway pass card, or a hotel pass-key card, for instance, the card reader may be locally programmed with a particular identification code which it must recognize in order to unlock the turnstile or hotel room door. When a card is swiped through the reader, if the code on the card matches the preprogrammed code on the reader, entrance is allowed. Otherwise, entrance is not allowed.

In another application for such cards, the card readers are capable, not only of reading information from the card, but also of writing information to the magnetic strip. For instance, a person may purchase a magnetically encoded card for use on a subway system. The card is at first encoded with the purchase price. However, every time the person uses the card to gain access to the subway system, the individual swipes it through a card reader which reads the current amount on the card, determines the cost of the subway ride which the person has just taken, deducts the cost of that ride and re-encodes the card with a new dollar amount equal to the previous amount minus the cost of the ride. The purchaser can use the card until it runs out of money.

Certain telephone companies issue similar cards for making telephone calls from public telephones.

One increasingly common use of magnetically encoded identification cards is in casinos. In particular, many casinos now offer their guests magnetically encoded identification cards (sometimes referred to as comp cards or complimentary cards) which the guest can use to accumulate points during their stay. At the end of their stay or at any other point during their stay, they can redeem the points for prizes and/or discounts at the hotel/casino complex.

For instance, slot machines or gaming tables at the casino may be provided with card readers. When a guest with a comp card sits down at the slot machine or gaming table, he or she inserts the card into the card reader and leaves it there during his or her stay at that location. The card reader will, for instance, credit points to the card for each pull on the slot machine or for each minute spent at the gaming table.

When the person moves on to another activity, he or she retrieves the card from the card reader which either re-encodes the card with the number of accumulated points, or sends information to a central processor to which the card reader is coupled (over a local area network, for instance) which keeps track of the number of points accumulated by each person.

A problem with the above described system is that guests frequently forget to retrieve their cards when leaving a gaming table or slot machine. Particularly at a gaming table, for instance, a person may have sat down and inserted the comp card into the card reader several hours earlier. Thus, by the time he or she gets up to leave, the comp card has been forgotten.

When the person realizes that the card has been lost, he or she must go to the courtesy desk of the casino to obtain a new card. Also, if the casino is using the type of system in which the card itself is encoded with the number of points (rather than the accumulated points being sent to a central memory under the control of the casino), those points will be lost by the guest. However, even more importantly, the time that it takes for the guest to obtain a new card is time away from the gaming tables, slot machine, or other activity. Accordingly, the casino is losing money during this time since the guest is not engaged in an income producing activity for the casino. Further, the guest is not accumulating points during the time which he or she is spending obtaining a new card.

Accordingly, it is an object of the present invention to provide a security chain for a comp card or similar card.

It is a further object of the present invention to provide a security chain for a comp card in which comp cards can be easily exchanged.

It is another object of the present invention to provide a comp card security chain the length of which can be easily adjusted.

It is yet a further object of the present invention to provide a comp card security chain which does not have a tendency to cause the card to be prematurely and/or inadvertently yanked out of a card reader.

SUMMARY OF THE INVENTION

The invention comprises a split ring which is detachably coupled to a ball chain by a snap-in ball chain coupler. The other end of the ball chain is detachably coupled by similar means to an alligator clip which can be clipped onto the users clothing. The split ring includes a right angle tab which extends towards the center of the ring, thus providing a flange over which a comp card can be easily inserted and threaded through the split ring onto the ring. The ball chain is preferably 42 inches in length. However, the chain can be cut down by the purchaser to any desired length since ball chains can be easily cut without degrading the quality, appearance or strength of the chain.

DETAILED DESCRIPTION OF THE INVENTION

Figure 1:
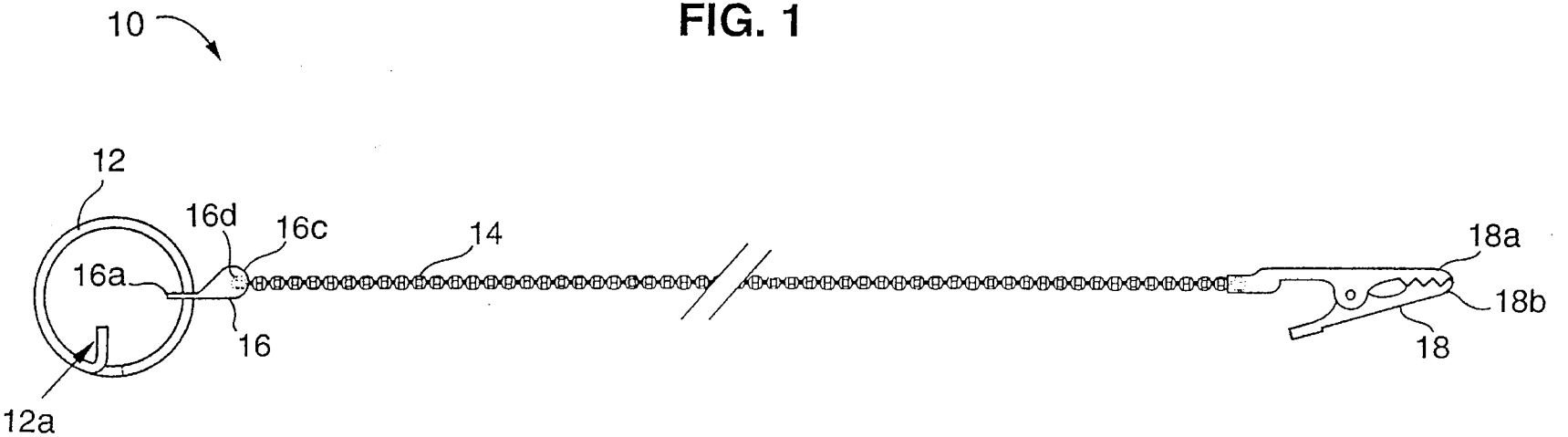
FIG. 1 is a plan view of the security chain of the present invention.
Figure 2:
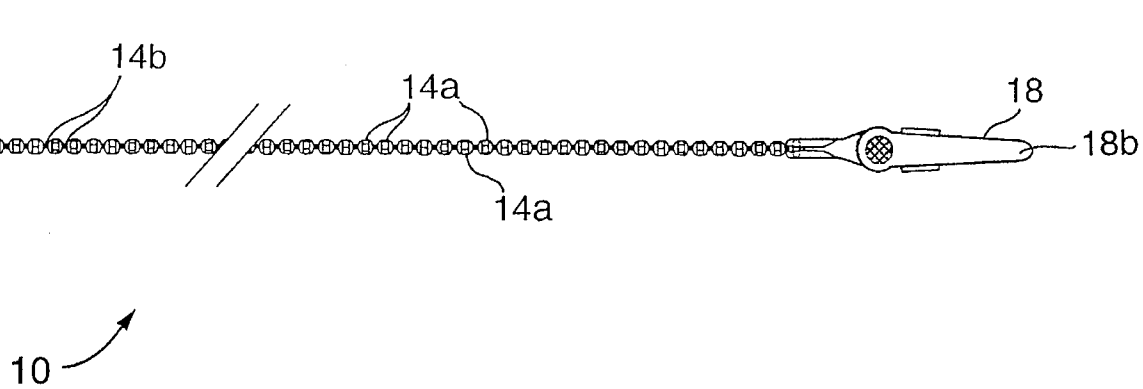
FIG. 2 is a side view of the security chain of the present invention.

FIGS. 1 and 2 show plan and side views, respectively, of the security chain of the present invention. As shown, a split ring 12 is attached to a ball chain 14. A split ring comprises a generally circular band of resilient material such as metal or plastic, wound upon itself two turns. A key or other item having a hole in it which is slightly larger than the thickness of the ring (which is about double the thickness of the double wound band) can be detachably coupled onto the ring by prying one end of the band away from the ring and inserting the hole over the end. The hole can then be slid all the way around on the band until it clears the opposite end of the band. At that point, the hole will surround both turns (or layers) of the band and will not disengage from the ring until the second end of the ring is pried away from the ring and the hole is slid all the way around on the band until it clears the first end of the band again.

The ring 12 is attached to the chain 14 by means of a connector 16. The connector 16 comprises a flange 16*a* defining a hole 16*b*. The hole is sized to accept the split ring 12. The connector 16 couples to the ball chain 14 by means of a ball snap-in end coupler 16*c*. As is well known, a ball chain comprises a plurality of usually hollow balls 14*a* coupled together by a series of filaments 14*b*. A gap 16*d* is provided in the ball snap-in coupler which is larger than the diameter of the filaments, but smaller than the diameter of the balls 14*a*. Accordingly, a ball can be inserted and retained in a cup 16*d* at the end of the snap-in coupler 16*c*. To insert a ball 14*a* into cup 16*d*, the filament can be forced through a space 16*e* between the two extensions 16*f* and 16*g*. The extensions 16*f* and 16*g* will resiliently spread apart for the filament to slide through and return to a closed position after the filament has passed through. Accordingly, the ball will prevent the chain from sliding through the gap 16*e* such that chain is now coupled to the connector 16. The chain can be easily removed by forcing the filament back out through the gap 16*e* which can be created between extensions 16*f* and 16*g*. However, application of force in a very specific direction is needed to do this. Accordingly, it is unlikely that the chain will slip out of the snap-in coupler of the connector 16 inadvertently.

The ring 12 includes a right angle tab 12*a* which extends a short way generally towards the geometric center of the ring. This tab allows items with holes such as a comp card or the connector 16 to have the hole easily inserted onto the flange 12*a* and threaded around the ring 12 until it is fully engaged on the ring.

As is well known, previous split rings which do not have such a tab required the user to pry apart the two halves of the ring in order to engage the hole of the item being inserted (e.g., a key or comp card) with the ring. A user would commonly would do this by applying fingernail pressure in between the two halves of the ring. This maneuver required a significant amount of manual strength and dexterity and has proven to be extremely difficult for many people. Tab 12*a* eliminates this problem.

An alligator clip 18 is attached to the opposite end of the ball chain 14. The alligator clip 18 is provided with a ball snap-in end coupler 18*c* essentially identical to the ball snap-in end coupler 16*c* of the connector 16 at the opposite end. The jaws 18*a* and 18*b* of the alligator clip can be clipped to the user's personal clothing.

To use the security chain, the user places the hole on the comp card over the tab 12*a* and threads the card onto the ring 12. The user then clips the alligator clip to his or her clothing. When the user sits down at a gaming table or a slot machine, he or she inserts the card into the card reader. Card readers are commonly designed so that the back end of the card remains exposed. Accordingly, the ring 12 which passes through the hole in the back of the card does not interfere with the insertion of the card into the card reader. If the user gets up without remembering to retrieve the card from the card reader, he or she will feel the tug of the chain when he or she steps sufficiently far away from the machine to bring the chain into full extension. The user will then remember to remove the card. Alternately, even if the user does not feel the tug, the tension in the chain will pull the card out of the card reader and still be attached to the person's clothing through the security chain.

The selection of a ball chain is advantageous over other options for several reasons. First, the chain is extremely light weight. Further, it is attractive and has a decorative and upscale appearance that would be acceptable to both men and women. Further, as previously noted, it is easy to customize the length of the chain with a pair of scissors.

The tab 12*a* makes it easy to connect a card to the ring 12. The alligator clip is advantageous in that should the card or chain get snagged on something, the jaws of the alligator clip 18 will release rather than rip the clothing as might occur with a more secure type of connector such as another ring or a hook-type connector.

A coiled plastic cord may be substituted for the ball chain. However, it is found that such cords are not as attractive and upscale in appearance as the ball chain. Further, men tend to dislike the appearance more than women. Even further, such cords tend to stretch out and remain stretched over time and thus have an even worse appearance. Finally, the coiled plastic cords tend to pull the card out of the card readers prematurely because of the spring retention factor of the coils.

A 42 inch chain length is found to be optimal in that a person can move around in his or her chair or even stand up while remaining at the gaming table or slot machine without tensioning the cord. On the other hand, it is short enough that should a person walk away from a gaming table or slot machine without remembering to remove the card from the card reader, the person will still be relatively close to the machine when the tugging action occurs.

It is found that a nickel plated steel split ring having a diameter of 24 millimeters is most suitable for comp cards or other cards which are generally the size of a standard credit card.

Further, the use of a ball chain and snap-in end couplers is advantageous. Particularly, if a person has several items which he or she may wish to use with the chain, (e.g., comp cards from several casinos or subway pass and a comp card, etc.) the chain can be provided with multiple split rings. The user can thread the various cards or other items each one onto a separate ring and can easily interchange rings by snapping in and out with the snap-in end coupler rather than having to remove the cards or other items from the split ring and inserting the new card or item onto the split ring.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

I claim:

1. An apparatus for preventing loss of a card comprising;

a split ring upon which a card can be detachably coupled by threading a hole in said card onto said ring, a ball chain having first and second ends detachably coupled to said split ring at said first end, a coupling member coupled between said ring and said ball chain having a hole so as to be capable of being detachably coupled to said ring by threading said hole onto said ring and further having a snap in end coupler for detachably coupling to said chain, and an alligator clip for clipping onto a person's clothing, said clip being detachably coupled to said second end of said chain.

2. An apparatus as set forth in claim 1 wherein said alligator clip further comprises a snap-in end coupler for detachably coupling to said chain.

3. An apparatus as set forth in claim 1 wherein said split ring comprises a generally circular band of resilient material wound upon itself at least two turns and having first and second ends, and a flange extending inwardly of said band from said first end of said band so as to form a tab over which said card can be inserted to thread onto said ring.

4. An apparatus as set forth in claim 3 wherein said chain comprises a plurality of spheres coupled together by filament.

5. An apparatus as set forth in claim 4 wherein said chain is about 42 inches long.

6. An apparatus for preventing loss of a card comprising;

a split ring comprising a generally circular band of resilient material wound upon itself at least two turns and having first and second ends, upon which a card can be detachably coupled by threading a hole in said card onto said ring, a coupling member having a hole detachably coupled to said ring by threading said hole onto said ring and further having a first snap-in end coupler for detachably coupling to said chain, a ball chain comprising a plurality of spheres coupled together by filament and having first and second ends, said first end being detachably coupled to said first snap-in end coupler, and an alligator clip for clipping onto a person's clothing, said clip further comprising a snap-in end coupler detachably coupled to said second end of said chain.

7. An apparatus as set forth in claim 6 wherein said ring further comprises a flange extending inwardly of said band from said first end of said band so as to form a tab over which said card can be threaded onto said ring.

* * * * *